US006640356B1

(12) United States Patent
Hans

(10) Patent No.: US 6,640,356 B1
(45) Date of Patent: Nov. 4, 2003

(54) METHOD FOR TRANSMITTING AND EVALUATING ADVERTISING AND INFORMATION IN TOILET FACILITIES AND A DISPLAY ARRANGEMENT FOR CARRYING OUT SAID METHOD IN A URINAL OR TOILET AREA

(75) Inventor: Keller Hans, Durnten (CH)

(73) Assignee: Doris Keller, Durnten (CH)

( * ) Notice: Subject to any disclaimer, the term of this patent is extended or adjusted under 35 U.S.C. 154(b) by 0 days.

(21) Appl. No.: 10/149,039

(22) PCT Filed: Dec. 13, 1999

(86) PCT No.: PCT/CH99/00600

§ 371 (c)(1),
(2), (4) Date: Jun. 7, 2002

(87) PCT Pub. No.: WO01/45075

PCT Pub. Date: Jun. 21, 2001

(51) Int. Cl.[7] ..... A47K 4/00; E03C 1/01; E03D 9/00

(52) U.S. Cl. ..... 4/664; 4/302; 340/573.1; 340/573.3; 600/301

(58) Field of Search ..... 4/664, 302; 340/573.1, 340/573.2; 600/301

(56) References Cited

U.S. PATENT DOCUMENTS

| | | | | | |
|---|---|---|---|---|---|
| 4,692,951 | A | * | 9/1987 | Taki et al. | 4/664 |
| 4,916,613 | A | * | 4/1990 | Lange et al. | 4/304 X |
| 5,031,258 | A | * | 7/1991 | Shaw | 4/664 X |
| 5,435,018 | A | | 7/1995 | Nishimoto | |
| 5,867,848 | A | | 2/1999 | Ort | |
| 2002/0044103 | A1 | * | 4/2002 | Paulson | 345/1.1 |
| 2003/0078966 | A1 | * | 4/2003 | Kinjo | 345/1.1 X |

FOREIGN PATENT DOCUMENTS

| | | | |
|---|---|---|---|
| DE | 29811821 | U1 | 10/1998 |
| EP | 0303568 | A | 2/1989 |
| FR | 2534399 | A | 4/1984 |

* cited by examiner

*Primary Examiner*—Gregory L. Huson
*Assistant Examiner*—Kathleen J. Prunner
(74) *Attorney, Agent, or Firm*—Volpe and Koenig, P.C.

(57) ABSTRACT

An advertising surface on which advertising is conveyed through still or moving images is mounted on or above a urinal (1). The advertising is activated by the user of the urinal (1) when he approaches the same. The advertising can be controlled through the Internet and can be adapted to the location and the time of transmission.

12 Claims, 2 Drawing Sheets

METHOD FOR TRANSMITTING AND EVALUATING ADVERTISING AND INFORMATION IN TOILET FACILITIES AND A DISPLAY ARRANGEMENT FOR CARRYING OUT SAID METHOD IN A URINAL OR TOILET AREA

BACKGROUND

The invention relates to a process for transmitting and evaluating advertising and information in toilet facilities.

The invention is furthermore related to a display arrangement for carrying out the method in a public urinal or toilet area.

Urinals are usually fastened in larger numbers alongside one another on the wall in toilet and public urinal facilities. Modem urinals are provided with automatic flushing capability. These are activated, with a time delay, when the user approaches. The control for activation of flushing with water is usually found above the urinal and is usually built into the wall. With waterless urinals, as they likewise have been offered for some time, water flushing is dispensed with, and therefore the corresponding devices and controls for triggering flushing are also absent.

Occasionally on walls in public toilet areas, advertising by poster, the effectiveness of which is nonetheless restricted because toilet areas are mostly quickly vacated again, and during the operation, the advertisement is either not visible, or cannot be observed, or the latter has been damaged by vandalism.

From DE-U1-29811821, an audiovisual information system for toilet facilities is known in which a display device in toilet spaces is activatable by sensor devices as a function of contact element or sensors. A disadvantage of this apparatus is that the display device and the sensor device are arranged independently of other apparatuses of the toilet facilities, and as additional equipment on a door or a walling bounding the space. The expense and the costs for installation are correspondingly high. DE-U1-29811821 indeed discloses the possibility of unilateral transmission of advertising or information from an audiovisual source through connection lines to video screens of the display device. A bilateral transmission of information or a bilateral communication is not provided.

In U.S. Pat. No. 5,435,018, a device for diverting and absorbing odors in connection with a urinal is described. It contains an odor guide apparatus which can include a housing with odor-neutralizing material. The housing serves for diverting and/or absorbing odors, and can in addition be used as advertising space. The housing is mountable by means of a holder on the upper side of the urinal. U.S. Pat. No. 5,435,018 discloses the use of interchangeable advertising plates, but not the use of advertising facilities on which or from which commercials or information are transmittable. An evaluation of information on the observation of such advertising is likewise not provided.

In U.S. Pat. No. 5,867,848, an advertising facility insertable into a urinal which bears an advertising message as a thermochromal image is described. This becomes visible by contact with warm urine and disappears again upon subsequent flushing with cold water. With such advertising facilities, the latitude for configuring the advertising message is very small. Moreover, such advertising facilities provide no evaluable information.

SUMMARY

The object of the invention is to provide a method for transmitting and evaluating advertising and information in toilet facilities.

The object of the invention is furthermore the creation of a display arrangement with which a commercial or informational message can be transmitted to the user during his stay in the toilet.

These objects are accomplished by a method for transmitting and evaluating publicity and information in accordance with the features of patent claim 1 and through a display arrangement in accordance with the features of patent claim 4.

Through the arrangement of the display in the immediate field of vision, that is, in the upper region of the urinal, the wash basin or in a receptacle arranged above it the eyes of the user are necessarily directed toward it, and they absorb (consciously or unconsciously) over a sufficiently long time the advertising message or orgaizational communications of the building. By activating or turning the display on by the user of the toilet, the latter is actively led to look in that direction. In the simplest configuration of the invention, this is an-interchangeable-commercial message in word and/or image form which is installed beneath a preferably well cleanable transparent surface on or above the urinal or wash stand. By turning on background illumination, the advertising message is activated.

In a further advantageous configuration, stationary or moving images or films with or without sound can be transmitted with a video screen which are transferred either by a storage medium which is set up within the operation. In a wholly special embodiment, the advertising messages can be broadcast by cable, radio or Internet by a state or regional administration to displays in the branches, service areas etc. and in this way be continuously updated. The transmission of data within the business can take place though separate lines or over the electrical power grid mostly available in any case or radio.

BRIEF DESCRIPTION OF THE DRAWINGS

The invention will be explained in greater detail by way of a preferred embodiment of an arrangement in a public urinal, wherein.

DETAILED DESCRIPTION OF THE PREFERRED EMBODIMENTS

Figure 1:
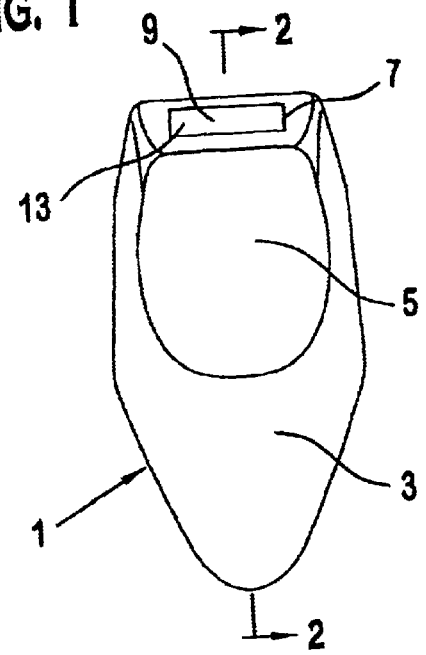
FIG. 1 is a view of a urinal with a built in display arrangement.
Figure 2:
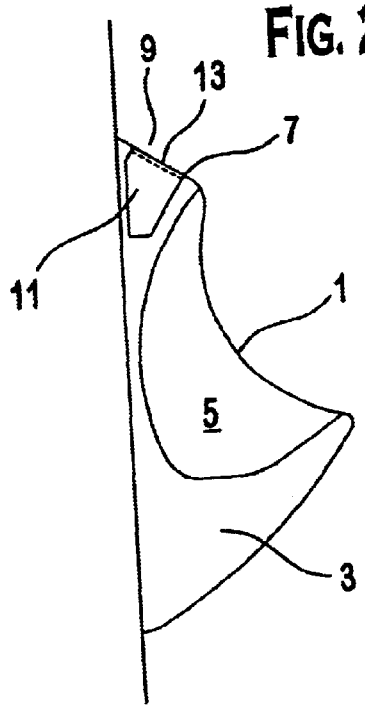
FIG. 2 is a longitudinal section along line II—II through the urinal in FIG. 1.

On a urinal 1, which includes a foundation 3 of ceramic material, metal or plastic, a collecting trough 5 is visible in the central region on the lower end of which (not visible) the drain opening is arranged. Above the collecting trough 5, in the first configuration of the invention, a display arrangement 9 is installed in the foundation 3 in a recess 7. The display arrangement 9 is preferably accommodated in a splashed water-tight receptacle 11, which contains the technical means, such as lighting and/or control unit and/or receiver for the reproduction of the advertising. Above the receptacle 11, a covering 13, for example a transparent pane of plastic or glass, is mounted. This prevents access to the receptacle 11 and closes it off in a water tight manner in order to enable cleaning the urinal 1 in the customary manner.

The reproduction of the advertising message can in the simplest case take place through insertable sheets 15 on which a printed advertisement appears in word and/or image. The sheets 15 can be exchanged as needed in shorter or longer time segments. For this, on the covering 13 closing off the container 11, an additional plate 12 of plastic or glass lies, which can be lifted off for changing the sheets 15. This plate 12 protects the content of the container 11 additionally from the unauthorized access of outside parties. Preferably for this reason, the covering 13 and the plate 12 are joined through separate screwed connections.

A light in the container 11, which is first turned on with the use of the urinal 1 after the approach of the user, makes the user attentive toward the advertising message or other types of information.

Figure 5:
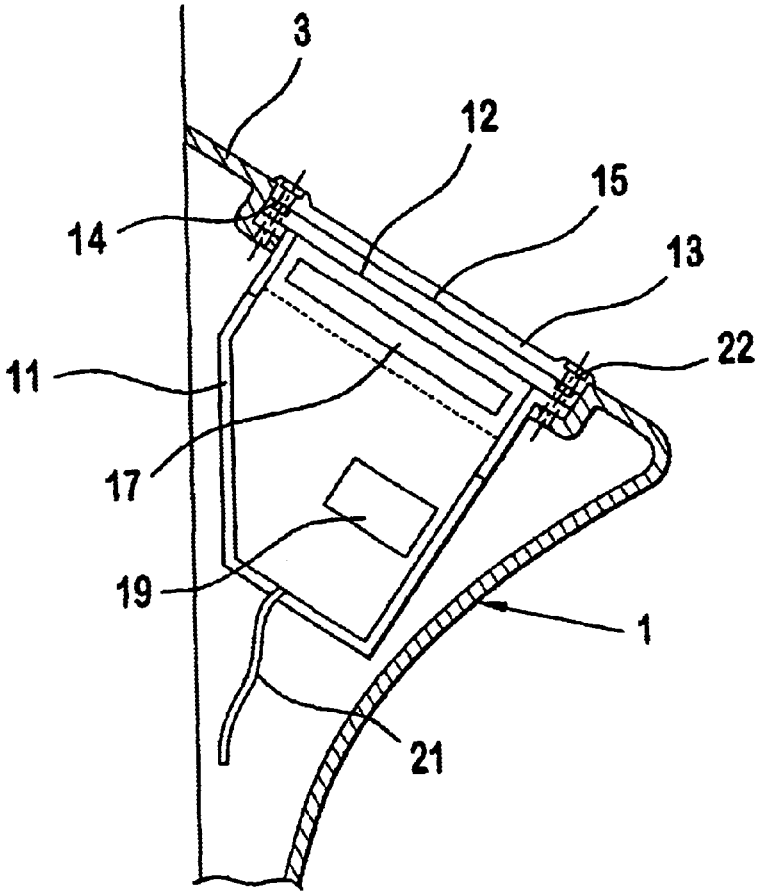
FIG. 5 is a cross section through the receptacle for the display arrangement with an insertable surface for images and a video screen.
Figure 6:
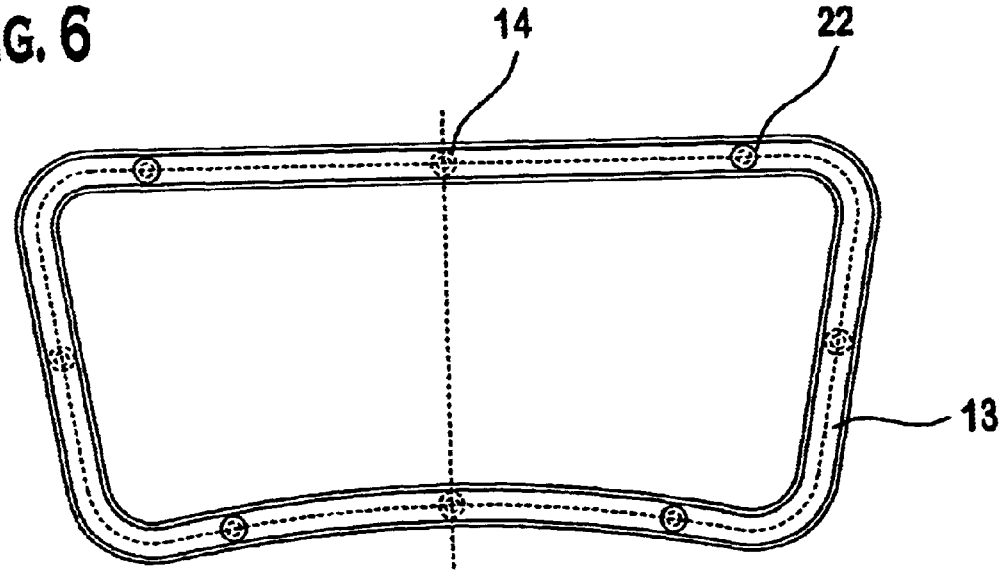
FIG. 6 is a view of the display arrangement for stationary images/texts or for a screen representation.

The especially advantageous configuration of this invention includes in the container 11 a video screen 17 on which once again images can be represented, or sound befitting this can be reproduced. In the simplest configuration, the images or sounds are transmitted from a storage medium 19 inside the receptacle 11, as is schematically represented in FIG. 5, to the video screen 17 and/or a speaker. The transmission of the images and sound can, however, also take place through a line 21 from a memory device arranged in the office of the operation, and from thence not only the image material can be determined, but also the time of day in which certain images or films are to be shown. For example, at times in which the toilets are primarily used by truck drivers, advertisements for trucks or accessories can be transmitted. In the evening when primarily young people are underway and use the toilets, information on evening functions and/or other advertisements which relate to young people can be transmitted. In snack bars, especially if it is a matter of localities with large international food operations, advertising transmissions can be controlled from the control center. This makes it possible, not only in one restaurant, but in hundreds or thousands or restaurants, for adapted advertising programs to be able to be transmitted at certain times. Such transmissions can take place today over the Internet without further ado, and within buildings. Such data can be transmitted via a special data network or through the electrical grid of the building wiring to the video screens. In particular at highway rest areas, traffic reports can also be transmitted, represented optically on a street map.

Through the use of inherently familiar technology, such as proximity switches and the like, the advertising can be turned on as soon as a user approaches the urinal. Turning on the reproduction of the advertising message can be triggered by a sensor arranged above a urinal 1 or in a washstand, in the receptacle 11, on a wall or on the floor. Turning off takes place correspondingly when the user leaves the urinal or dressing table. The duration of use derived from the duration of the stay can be stored and be allocated to the commercial offered and be evaluated by publicity specialists. Thus statistics can also be compiled as to how long the user views a certain ad or whether he at best remains longer than usual in front of the video screen because of the running commercial. If commercials are transmitted which relate to the offering of the restaurant, in which the urinal is set up, then sales promoted by the publicity can, if desired, be statistically recorded. If urinals provided with display arrangements are set up in airports, then in addition to commercials, information on planes departing shortly or delays can be transmitted.

With advertising time sold, additional resources for the costs of cleaning and maintenance of toilet facilities can be brought in. In this way, the in many cases not very hygienic toilet areas can be cleaned and restored better and above all at shorter intervals.

Figure 3:
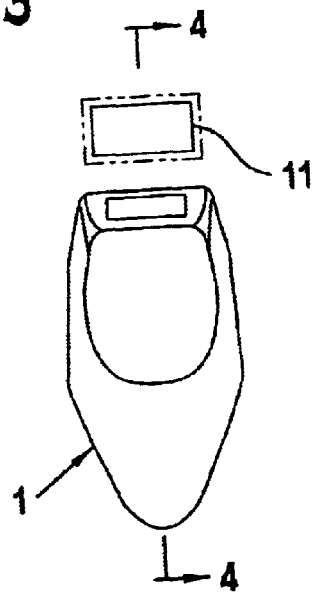
FIG. 3 is a view of a urinal with a display arrangement installed above the urinal.
Figure 4:
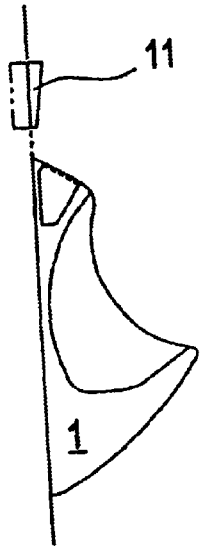
FIG. 4 is a longitudinal section view taken along line IV—IV.

In the configurations of the invention in accordance with claims 1, 2 and 5, 6, the receptacles 11 are built into the urinal 1. In the configuration of the invention in accordance with FIGS. 3 and 4, the receptacle 11 is fastened as a separate element above the urinal 1 on the wall. Of course, the display can in addition also be set up by the wash basins.

What is claimed is:

1. Method for transmitting and evaluating advertising and information in toilet facilities including an advertising facility in a field of vision of a user during use of the toilet, public urinal or wash basin, wherein a frequency of use and or a duration and/or point of time within a day are recorded by a storage medium.

2. Method according to claim 1, wherein the frequency of use, the duration and/or time within the day that are recorded by a storage medium are transmittable to a control center for evaluation through a line or a wireless transmission.

3. Method for transmitting and evaluating advertising and information in toilet facilities, including an advertising facility in a field of vision of a user during use of a public urinal or wash basin, wherein an advertising message or information is transmitted over a line, wirelessly or by an Internet connection from a business or from a national or international control center.

4. Method according to claim 3, wherein the advertising facility is set into operation by an approaching user through a sensor and is placed out of operation when the user departs.

5. Display arrangement for carrying out the method according to claim 3, including a receptacle (11) for interchangeable accommodation of an advertising facility, a transparent plate (13) for protection of the advertising facility and an illuminating device for the advertising facility and/or a device for reproduction of sounds, wherein the receptacle is at least partially embedded into the public urinal, wash basin, or the automatic flushing facility.

6. Display arrangement for transmitting and evaluating advertising and/or information in toilet facilities in a field of vision of a user during use of at least one of a toilet, public urinal or wash basin, wherein a frequency of use and or a duration and/or point of time within a day are recorded by a storage medium, the display arrangement including an advertising facility and a sensor, wherein resources for processing sensor information and for storage of a frequency of use and/or a duration and/or a point of time within a day are provided.

7. Display arrangement according to claim 6, wherein the advertising facility includes a video screen (17) on which stationary or moving images are produced.

8. Display arrangement according to claim 7, wherein the advertising facility includes a play back device (19), or wherein the information is transmittable through a transmission line (21) or by radio to the advertising facility.

9. Display arrangement according to claim 8, wherein the transmission takes place through the Internet.

10. Display arrangement according to claim 6, wherein the reproduction of the images or illumination of the advertising facility can be turned on by the user at the beginning of use of the urinal and/or the wash basin.

11. Display arrangement according to claim 10, wherein turning on the reproduction of the image or illumination is triggerable by a sensor arranged on the urinal (1) or on the wash basin or in the receptacle (11), or on a wall or floor.

12. Display arrangement according to claim 10, wherein the storage medium for recording and/or the resources for evaluating the data is arranged in the control center of the toilet operator.

* * * * *